United States Patent [19]

Kuhn

[11] 4,428,543

[45] Jan. 31, 1984

[54] APPARATUS AND METHOD FOR REPLACING A FINISHED ROLL WITH AN EMPTY ROLL CORE IN A DOUBLE-DRUM WINDER

[75] Inventor: Friedrich Kuhn, Heidenheim, Fed. Rep. of Germany

[73] Assignee: J. M. Voith GmbH, Fed. Rep. of Germany

[21] Appl. No.: 312,303

[22] Filed: Oct. 16, 1981

[30] Foreign Application Priority Data

Oct. 25, 1980 [DE] Fed. Rep. of Germany ..... 3040398

[51] Int. Cl.[3] ..... B65H 17/12

[52] U.S. Cl. ..... 242/66

[58] Field of Search ..... 242/66, 56 R, 56.6

[56] References Cited

U.S. PATENT DOCUMENTS 3,841,578 10/1974 Dorfel ..... 242/56 R X
3,918,654 11/1975 Okubo et al. ..... 242/56 R
4,135,674 1/1979 Bartmann ..... 242/66 X
4,304,368 12/1981 Bartmann ..... 242/66 X
4,324,369 4/1982 Bartmann ..... 242/66

*Primary Examiner*—John M. Jillions
*Attorney, Agent, or Firm*—Ostrolenk, Faber, Gerb & Soffen

[57] ABSTRACT

The disclosure concerns both an apparatus and a method for replacing a finished web roll with an empty core and roll support in a double-drum type web winder. The web winder has a winding station at which a pair of drums wind a web on a roll support carried on an extractable core. The finished roll is moved across a transfer table to an extraction table at which the core is removed laterally. At the extraction station, the removed core is reinserted in a new web roll support. The core and new web roll support are pivoted up to an upraised waiting position. A newly finished roll at the winding station is moved toward the extraction station. The new web support and the core within it are moved above the just-finished roll and are delivered to the winding station for winding the next web roll on the core and new roll support.

15 Claims, 2 Drawing Figures

APPARATUS AND METHOD FOR REPLACING A FINISHED ROLL WITH AN EMPTY ROLL CORE IN A DOUBLE-DRUM WINDER

BACKGROUND OF THE INVENTION

The present invention relates to web roll winding apparatus, particularly apparatus for replacing a finished roll with an empty core in a double-drum web winder, particularly for a web of paper, and to a method of replacing a finished roll by means of such an apparatus.

A drum winder includes a winding station on which a roll is wound with a web, a transfer table across which a push-off device rolls the finished roll from the winding station to an extraction station, and an extraction station including a laterally arranged device for pulling out the winding shaft. Such drum winders are positioned at the place where webs are to be wound, for instance at the end of a paper making machine or following a doubling or lining machine, or the like.

In one known double-drum winder, a winding core is generally covered by a cardboard tube that serves as a support for the wound roll. The core is pressed by hydraulic means along a guide to move against the two parallel drums of the double-drum winder. When a roll has been wound to the desired diameter, the core guide for the core is withdrawn. Then the wound roll is brought to a station for the extraction of the core from the roll, i.e. from the cardboard tube roll support. For this purpose, it is known, for instance, to press the roll off over the front drum and to roll it across a transfer roller table to an extraction station where the core is pulled out by means of an extractor. The roll is then moved away. The core is again provided with a new roll support or cardboard tube and is then moved back over the roller table to the winding station. During this return movement, the core is left to itself over given distances across this roller table. The core is then intercepted again and is repositioned until it finally arrives, as accurately aligned as possible, into the drum bed. However, shortly in front of the drums, the new core must be lowered or raised somewhat in a prism, in order that the finished roll which has just been wound can be rolled over the same roller table to the extraction stations, either above or beneath the empty core. Particularly for webs of large width, the core may be very heavy and may even weigh a ton or more. Upon its return rolling, there is the danger that the core will cant or jam. This can cause damage both to the core itself as well as to the drum. Handling is difficult and complicated and there is also a danger of accidents. The change-over times for substituting new cores are relatively long.

In another known roll winding apparatus, the roll is grasped by one lever of a double-armed lever mounted in a frame and is conveyed in an arc in the direction of travel to a delivery or extraction station. At the same time, a new core is brought to the winding station by the other end of the lever. Although the turnover time is shortened and handling is simplified, the disadvantage of this apparatus, which in itself is very suitable, is that the core must have such flexural strength that it can support a full roll. Thus, the diameter of this core must be of a certain minimum size.

Examples of such double-drum winding apparatus as are described above can be found in U.S. applications Serial Nos. 129,675, filed Mar. 12, 1980, now U.S. Pat. No. 4,304,368 and 165,954, filed July 3, 1980, now U.S. Pat. No. 4,324,369 both by Bernhard Bartmann and both assigned to the assignee hereof.

SUMMARY OF THE INVENTION

The object of the present invention is to provide a roll changing apparatus of the aforementioned type and to provide a method by which the roll change can be carried out rapidly with both very heavy and long cores and with thinner cores and wherein the method is simpler and less susceptible to breakdown in handling than with known devices of this type.

The present invention involves apparatus in which a lever is supported on each side of the web. The free ends of the levers have grippers for grasping an empty core. The levers are mounted for moving, and particularly pivoting, between the extraction and winding stations, so that in one terminal position, the grippers are in the extraction station to receive an empty core, while in the other terminal position, the grippers are in the winding station to deliver the core. The path of swing of the grippers between the winding and extraction stations extends above the finished roll.

The above described apparatus performs a method of replacing finished wound rolls with empty cores, wherein the finished roll is conducted over the transfer table to the extraction station, the core is pulled out at that station and after the finished roll has been moved away, the same core is again brought into the extraction station. During the winding of a new roll at the winding station, the empty core is swung by the levers into a waiting position between the extraction and winding stations. Upon the rolling away of the finished roll to the extraction station, the empty core is swung above that roll into the winding station.

Through use of the apparatus and method of the invention, it is possible to move even a very heavy core on a precisely defined path from the extraction station onto the drum bed without the core jamming or canting. On the other hand, it is also possible to use relatively thin, light cores, whose flexural strength is not sufficient for the cores to bear a full roll by supporting the cores at its ends. The change-over time is substantially reduced as compared with known double-drum winders, handling is simpler and easier, and fewer parts and control members are required for the return of the empty core. Furthermore, cores and drums are assured substantially gentler treatment and there is less danger of accidents.

Other objects and features of the invention will be described in further detail below with reference to the accompanying drawings.

DESCRIPTION OF A PREFERRED EMBODIMENT

Figure 1:
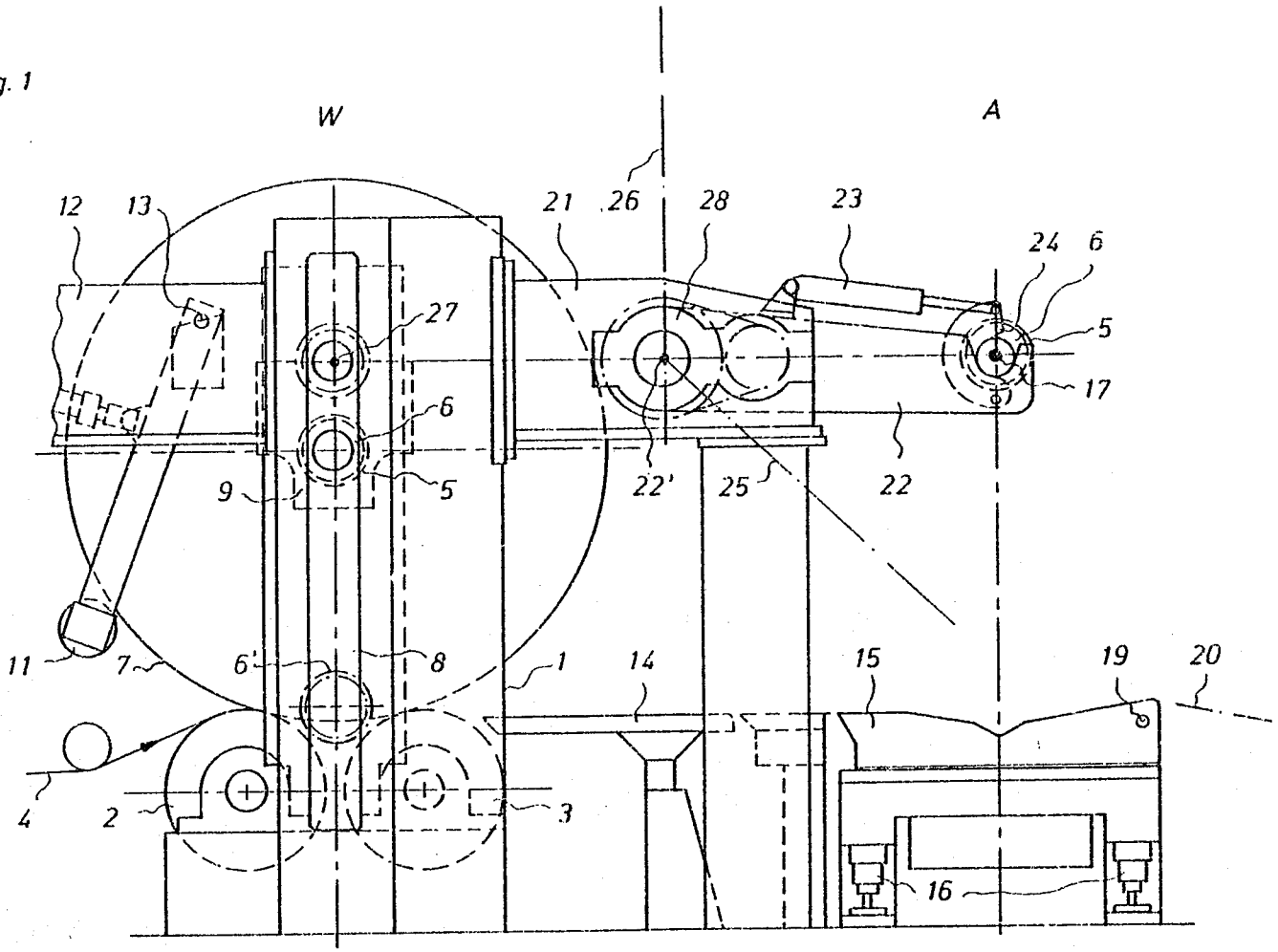
FIG. 1 is a diagrammatic view showing the basic principle of the apparatus of the invention, seen in side view.
Figure 2:
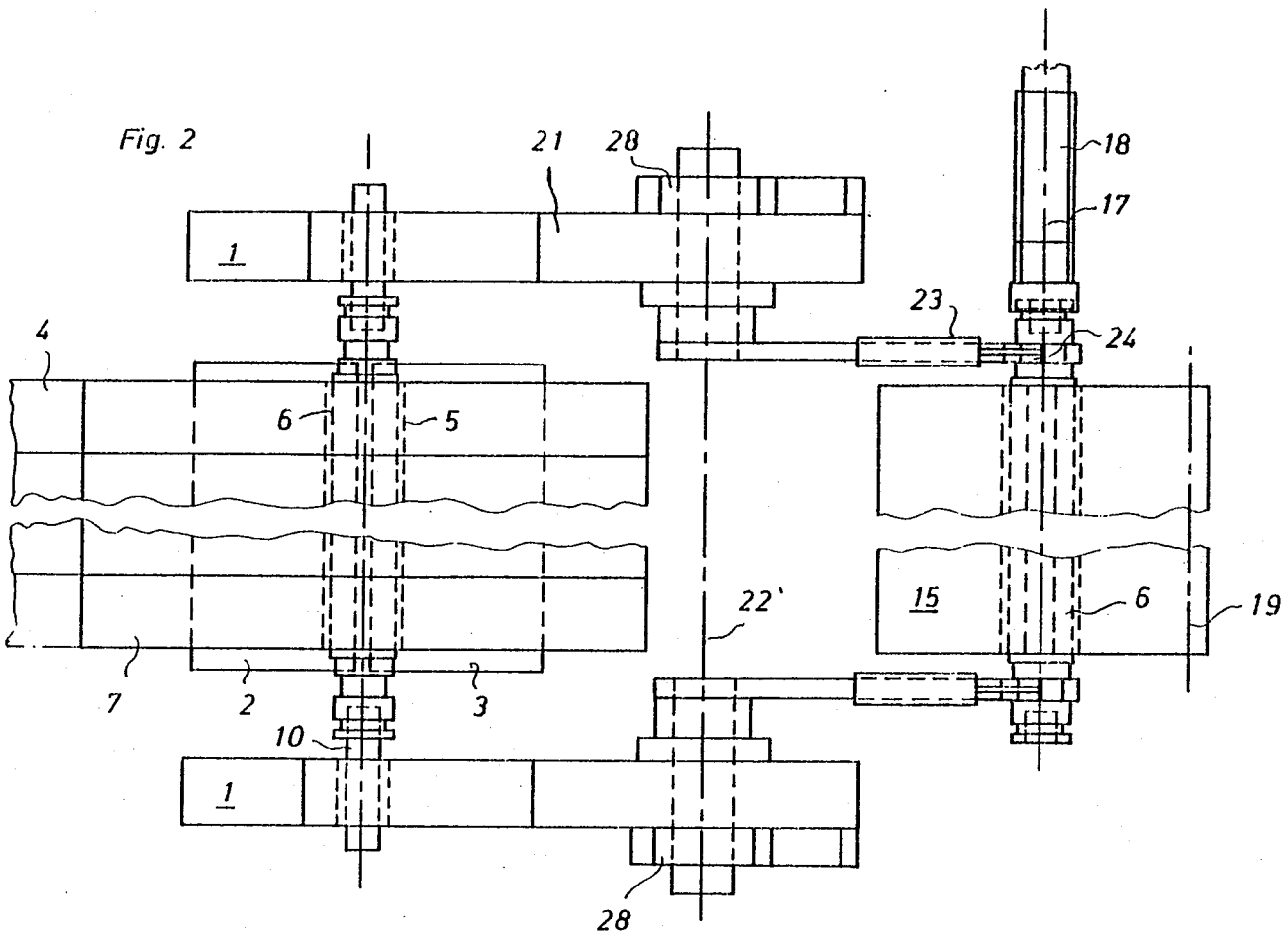
FIG. 2 is a diagrammatic plan view of the apparatus shown in FIG. 1.

The double-drum winder of FIG. 1 includes a frame 1 in which are mounted two parallel, motor-driven drums 2 and 3. Paper webs 4 coming, for instance, from a lining machine are wound on a winding core 6 that is covered with a roll support in the form of a cardboard tube 5, and the wound web forms a roll 7. The core 6 is guided at both of its ends for vertical motion by means of guides 9 that are located in guide slots 8 provided in the frame 1. The guides 9 are adapted to be moved hydraulically vertically, in a known manner (not shown). Within the guides 9, there are mounted hydraulically operated horizontally displaceable clamping heads 10 (FIG. 2 ) which grip against the ends of the core 6.

As roll winding starts, the core which is covered with a cardboard tube lies on the drums 2 and 3, as indicated by the core 6' shown in dot-dash line. When the roll 7 has been wound to the desired diameter, the clamping heads 10 are moved away. The roll 7 is rolled out of the winding station W over the transfer table 14 to the elevator table 15 by means of the hydraulically actuatable push-off lever 11 which is mounted on a beam 12 of the frame at 13. The elevator table 15 is first raised by the hydraulic cylinder 16 to such a height in the extraction station A that the center line of the core 6 is aligned with the center line 17 of the extraction device 18.

In this position, the core 6 is pulled out of the finished roll 7 by the extraction device 18. The roll is then lowered, and by the tipping of the elevator table 15 around the shaft 19, the roll 7 is rolled away over the ramp 20, indicated in dash line. Now, a new cardboard tube 5 is placed on the elevator table 15, and the elevator table is raised until the center line of the tube 5 is again aligned with the center line 17 of the extraction device 18. The core 6, which had been previously pulled out of the finished roll 7, is then introduced into the new cardboard tube 5.

On the longitudinal members 21 of the frame 1, levers 22 are mounted for pivoting around the shaft 22'. The levers are provided at their ends with holding yokes 24 which can be actuated by means of hydraulic devices 23. The swinging of the levers upward between the position 25 indicated in dot-dash line, past the position of the levers 22 shown in solid line into the waiting position 26, described further below, and further into the insertion position 27 and back again is effected by means of conventional drives 28.

The levers 22 are located in position 25 during the raising of the new cardboard tube 5 that had been placed on the elevator table 15. After the core has been inserted into the cardboard tube 5, the levers 22 are swung upward into the horizontal position until, in the position shown, they grasp the ends of the core 6. After the closing of the holding yokes 24, the levers 22 swing, together with the core 6, further up into the waiting position 26. They remain there until a new roll, which had been started during this process, has been completely wound and has been rolled under the new core 6 still in the waiting position 26, over the transfer table 14 and onto the elevator table 15. Directly after this, the levers 22 swing out of the position 26 until the core 6 has come into the position 27 and has been taken over by the clamping heads 10 of the guides 9. The holding yokes 24 are then opened and the new core is lowered onto the drums 2 and 3 into the position 6' shown in the drawing, where a new winding process commences.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Apparatus for replacing a finished web roll with an empty core and a roll support in a drum-type web winder, wherein the web winder comprises a winding station including drum means on which the web is wound on a roll support supported on a core; an extraction station removed from the winding station and including extraction means for extracting a core from a wound roll then at the extraction station; transfer means for transferring a wound roll from the winding station to the extraction station;

the apparatus for replacing comprises a support; a lever movably carried on the support; the lever having a free end with a gripper for gripping a core; lever moving means for moving the lever with respect to the support, the roll support at the drum means and the transfer means; the lever moving means moving the lever to move the gripper between the extraction station, where the gripper receives an empty core and roll support, and the winding station, where the gripper delivers the core and roll support to the web winder; the lever moving means raising the gripper to raise a core and a roll support supported on the core to pass over a finished roll which may be present at one of the winding station and the transfer means as the gripper moves that core and a supported roll support to the winding station and the support lever moving means and gripper being shaped so that the finished roll would be able to extend up to the upraised core and roll support.

2. The apparatus of claim 1, wherein the lever is pivotally carried on the support for swinging between the extraction and winding stations.

3. The apparatus of either of claims 1 or 2, wherein there are two of the levers connected to move together and each lever is mounted outside a respective lateral edge of the web; each of the levers having a respective gripper thereon and a lever moving means moving the grippers to move simultaneously.

4. The apparatus of claim 1, wherein the transfer means comprises a transfer table located between the extraction and winding stations and comprises a push-off device for rolling the finished roll from the winding station and over the transfer table.

5. The apparatus of either of claims 1 or 4, wherein the extraction means is positioned laterally of the finished roll at the extraction station and includes means for engaging the core and extracting the core laterally from the finished roll.

6. The apparatus of claim 3, wherein the levers are connected to the support for providing an open area between the levers and at the support through which a finished roll could pass, whereby the finished roll would be able to extend up to the upraised core and roll support.

7. Method for replacing a finished roll with an empty core and roll support in a drum-type web winder, comprising:

at a winding station, winding a web on a roll support, which roll support is carried on a core, until the web roll is finished; moving the finished roll over a transfer table from the winding station to an extraction station;

at the extraction station, before the finished web roll is moved there, placing a new roll support on a core; then raising up the core and new roll support thereon to be above the finished roll; moving the core and new roll support to the winding station while passing them over the finished roll which has been moved off the winding station and toward the extraction station.

8. The method of claim 7, further comprising removing the core from the finished roll at the extraction station.

9. The method of claim 8, wherein the step of placing a new roll support on a core comprises inserting the removed core in a new roll support.

10. The method of claim 8, further comprising repeating all of the foregoing steps, and wherein the step of placing a new roll support on a core comprises inserting the removed core in a new roll support.

11. Method for replacing a finished roll with an empty core and roll support in a drum-type web winder, comprising:

at a winding station, winding a web on a roll support, which roll support is carried on a core, until the web roll is finished; moving the finished roll over a transfer table from the winding station to an extraction station;

at the extraction station, before the finished web roll is moved there, placing a new roll support on a core;

moving the core and new roll support to a waiting position between the winding and extraction stations, until the finished roll is moved from the winding station; moving the core and roll support above the finished roll to the winding station from which the finished roll has been moved.

12. The methode of claim 11, wherein the core and new roll support are moved by swinging in an arc above the finished roll from the extraction station through the waiting station to the winding station.

13. The method of claim 11, further comprising extracting the core from the finished roll at the extraction station.

14. The method of claim 13, wherein the step of placing a new roll support on a core comprises inserting the removed core in a new roll support.

15. The method of any of claims 8, 9, 13 or 14, further comprising transferring the finished roll out of the extraction station following extraction of the core.

* * * * *